United States Patent [19]

Ganter

[11] 4,323,996

[45] Apr. 6, 1982

[54] ELECTRONIC WRISTWATCH HAVING ELECTRIC TERMINAL CONTACTS

[75] Inventor: Wolfgang Ganter, Schramberg, Fed. Rep. of Germany

[73] Assignee: Gebruder Junghans GmbH, Schramberg, Fed. Rep. of Germany

[21] Appl. No.: 187,537

[22] Filed: Sep. 16, 1980

[30] Foreign Application Priority Data

Oct. 4, 1979 [DE] Fed. Rep. of Germany ..... 2940246

[51] Int. Cl.[3] ..... G04C 23/02; G04B 1/00; G04B 37/00

[52] U.S. Cl. ..... 368/88; 368/204; 368/309

[58] Field of Search ..... 73/6; 368/203–205, 368/277, 186, 184, 187–189, 47, 88

[56] References Cited

U.S. PATENT DOCUMENTS

| | | | |
|---|---|---|---|
| 4,118,922 | 10/1978 | Ichiyanagi | 368/204 X |
| 4,165,605 | 8/1979 | Kashio | 368/186 |

FOREIGN PATENT DOCUMENTS

| | | | |
|---|---|---|---|
| 52-73074 | 6/1977 | Japan | 368/204 |
| 368428 | 5/1963 | Switzerland | 368/204 |
| 377736 | 6/1964 | Switzerland | 368/204 |
| 880121 | 10/1961 | United Kingdom | 368/204 |

*Primary Examiner*—Vit W. Miska

*Attorney, Agent, or Firm*—Burns, Doane, Swecker & Mathis

[57] ABSTRACT

An electronic wristwatch has electrical contact terminals accessible on the bottom side of the watch housing. The contact terminals are set in the bottom side of the housing in an electrically insulated matter and are supported elastically inside against a clock module contact surface. The contact terminals are accessible from the outside by means of a connector cap having counter contacts for engaging the terminals and connectors for engaging an auxiliary instrument which may be of the type which supplies data or power to the watch or which receives data from the watch. Instead of employing an auxiliary instrument separate from the connector cap, the connector cap itself may contain detection or measuring sensors so as to itself constitute the auxiliary instrument.

13 Claims, 3 Drawing Figures

ELECTRONIC WRISTWATCH HAVING ELECTRIC TERMINAL CONTACTS

BACKGROUND AND OBJECTS OF THE INVENTION

The invention concerns an electronic wristwatch with electric terminal contacts accessible on the bottom-side of the housing.

Such a wristwatch is known from German DE-OS No. 27 24 495. In that wristwatch the terminals are accessible after the removal of the bottom of the housing, i.e., the exposure of the battery and clockwork circuits inside the housing. These terminals are connected in an electrically conducting manner with slide register inlets and counter setting inlets, respectively, in order to be able to adjust the registers of the electronic clock circuit for the purpose of setting the watch display in accordance with certain storage state. For this purpose, the wristwatch, after the inside of the housing has been exposed, is placed on an auxiliary apparatus so that the exposed contacts press against elastically supported pins and the instantaneous setting of the reference register of circuit arrangements acting as the standard clock may be transferred. The particular disadvantage of this typical wristwatch involves the fact that the exposure of the inside of the housing poses the danger of interference with the operation. Furthermore, the mere pressure of the exposed contacts on the connecting pins, because of surface impurities may not provide, under certain conditions, the necessary ohmic safety of the contact with respect to the information to be transmitted. A typical wristwatch is known from German DE-OS No. 23 59 071. This watch has a case cast around the clock circuit and the display device that cannot be opened, and wherein contacts are cast in positions offset with respect to the rear external surface of the housing. The contacts are accessible by means of metallic shorting plugs through blind holes and short-circuitable among themselves, in order to expose certain dividing stage inlets temporarily to pulses higher than the operating frequency, for the purpose of adjusting the time display of the watch. However, the safety of ohmic contacting is even worse than noted above, in view of interfering deposits on the external surfaces of the cast-in contacts.

It will be appreciated that the data processing and display potentials of advanced wristwatches may be adapted to the individual needs or interests of the wearer of the watch by means of auxiliary instruments, without the requirement of small, special manufacturing series. Thus, it is the object of this invention to provide a contacting device in watches of this type that is simple to handle and electrically secure, so that the watch may be used universally as a processing and display instrument, together with interchangeable auxiliary instruments, including charging units for recharageable batteries, without detrimentally affecting in a substantial manner the aesthetic appearance expected of such a watch when worn on the arm of a person, in cases when such peripheral devices are connected with the watch.

BRIEF SUMMARY

This object is attached according to the invention in a wristwatch of the type including a housing, a clock module within the housing, and electric contact terminals accessible on a bottom side of the housing. Contact terminals are inserted in an electrically insulated manner in the bottom side of the housing and are supported under pressure against contact surfaces of the clock module.

The invention provides the advantages that the terminal contacts are accessible easily and without the need for exposing the inside of the housing and that the styling of the wristwatch and the dust and water-tight layout of its case are not affected, in particular even after the removal of the bottom of the case and the replacement of a used battery.

Preferably, there may be provided a connector cap which connects the terminals to an auxiliary instrument, or itself constitutes such instrument. The layout of the connector cap may be such that different cap connectors are provided for different auxiliary instruments in the sense of differential equipment with counter contacts, so that only certain ones of a plurality of terminal contacts arranged in the bottom of the watch case will be used. The quality of the electrical engagement itself is very high, because the wristwatch is secured to the arm of the wearer with the connector cap clamped therebetween, which further promotes the contact engagement. The connector cap itself may be very flat, because it needs only contain the counter contacts which are to abut against convex projections protruding from the housing bottom of the terminal contacts, so that an undesirable increase in the effective height of the wristwatch with the peripheral device attached, is avoided.

In the interest of simple handling or application and removal, respectively of the connector cap, it is entirely adequate to provide frictional seating on the housing and possibly, in a modified embodiment of the invention in order to further secure such seating, to provide a magnetically supported frictional connection.

In the interest of the safe establishment of the electrical contact, it may be further appropriate to effect the connection of the connector cap by a rotational motion of the connector cap with respect to the bottom of the housing and thus with respect to the terminal contacts. This provides a self-cleaning effect of the external surfaces of the contacts for functionally safe electrical contacting.

It may also be guaranteed that the contact terminals of the module are activated only when the connector cap occupies a predetermined position between the connector cap and the bottom of the housing. This is achieved by a central pin on the connector cap which engages a switch in the housing.

THE DRAWING

Further characteristics and advantages of the invention are found in the description hereinbelow of preferred embodiments of the invention depicted in the drawing, including a modification concerning the fastening of the cap connector in the bottom area of the housing of the wristwatch. In the drawing.

DETAILED DESCRIPTION OF PREFERRED EMBODIMENTS OF THE INVENTION

Figures 1, 2, 3:
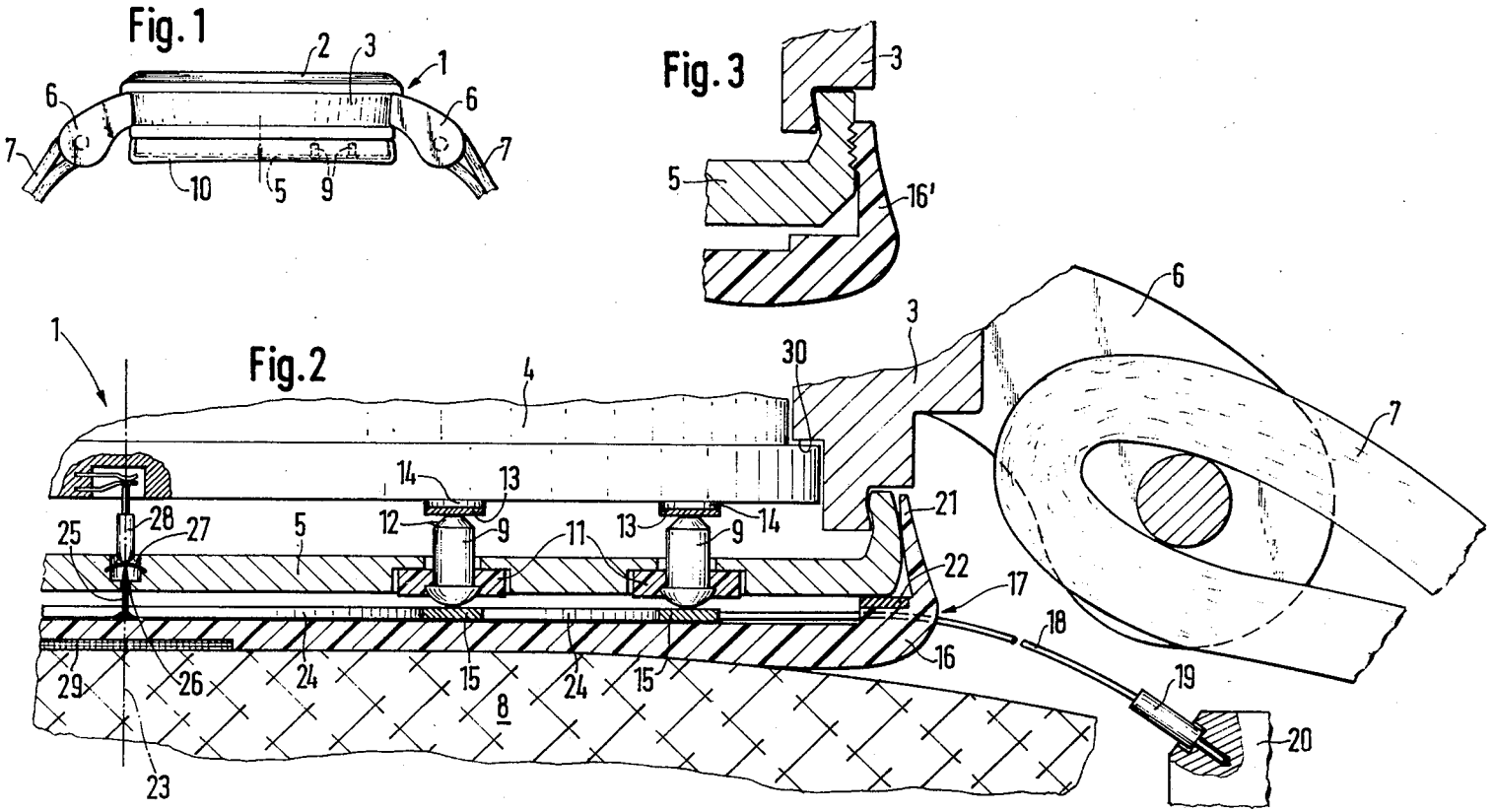
FIG. 1 shows a wristwatch according to the invention in a side elevation.
FIG. 2 depicts the wristwatch in a sectional and enlarged condition with a connector cap for securement to an auxiliary instrument.
FIG. 3 shows a modification with respect to FIG. 2 concerning the connection of the connector cap with the bottom of the housing of the wristwatch.

In FIG. 1 a side elevation of an electronic wristwatch 1 is shown, wherein under a watch glass 2 a digital or analog display device is arranged. The display is actuated by an electronic clock module 4 (see FIG. 2) secured in a housing 3 in any known manner. For the purposes of the present description of the invention, a cover-like case bottom 5 arranged opposingly to the watch glass 2, is considered a part of the housing 3. That bottom 5 is connected with the other parts, particularly the lateral parts of the housing, in any known manner, in order to hermetically seal the internal space of the housing 3 against external effects and simultaneously to fixedly secure the clock module 4 and possibly a battery (not shown in the drawing) to power the watch. On the side of the housing 3, connecting fittings 6 are formed for a bracelet 7 for attaching the wristwatch 1 to the arm 8 (FIG. 2) of a wearer.

Terminal contacts 9 project slightly in a convex configuration from the rear external surface of the bottom 5. The contacts are electrically connected with the electronic circuit of the clock module 4. The electrical connection (not shown in the drawing) is preferably effected so that even an electric short circuit over the projecting, ohmically accessible convex surfaces of the contacts 9 would not detrimentally affect the operation of the wristwatch 1. In such a case, at least leakage current connections over the projecting convex surfaces of the contacts 9 would not cause interference with the operation of the wristwatch 1, as the result of their contact with the surface of the arm 8 of a wearer of the watch. For psychological and possibly also aesthetic reasons, it is, however, preferable to provide a cover 10 under the bottom 5. The cover may comprise a flat synthetic plastic dish in the shape of a watch glass, which may be clamped simply onto the circumferential rim of the bottom and conforms in its outward styling to the color and design of the rest of the housing 3. The convex surfaces of the contacts 9, when not needed operationally, are neither optically nor electrically exposed.

If, as shown in FIG. 2, the bottom 5 comprises an electrically conductive material, insulated lead-ins 11 are provided therein, whereby the contacts 9 penetrate through the bottom 5. The ends 12 extending toward the inside of the housing 3 abut under pressure against the contact surfaces 13 on the electronic clock module 4 fixedly attached to the housing. There are thus created connections with the internal circuit of the clock module 4. This contacting may be effected by means of metallic spring elements 14, possibly in the form of helical or leaf springs, or alternatively by electrically conducting elastic masses or elastic masses coated with an electrically conducting substance, such as thin cushions of rubber or another rubber elestic material with wire guaze of metal film coverings (in view of the fact that only weak currents are to flow through these contact arrangements, even a strongly graphite containing rubber elastic material may be used under certain conditions). By means of the resilient pressure exerted by the bottom 5 of the clock module 4, the latter is pressed during the assembly of the wristwatch 1 (i.e., during the anchoring of the bottom 5 on the rest of the housing 3) in a position predetermined by the layout, against a mounting seat 30 on the housing 3. The module 4 is secured in this position upon the completion of assembly of the watch. Following that assembly, the electrically conductive engagement between the contact ends 12 and the cooperating contact surfaces 13 will not be opened again and the bottom 5 in the assembled position hermetically seals the internal space of the housing 3. Accordingly, preventive measures directed at the self-cleaning of those contact locations may be omitted.

If the convex surfaces of the contacts 9 projecting from the outer surface of the bottom 5 are to be electrically accessible for the attachment of auxiliary instruments (20 in the case of external layout of FIG. 2), a connector cap 16 equipped with counter contacts 15 for the contacts 9 is set onto the bottom 5 of the housing 5 (FIG. 2), after the removal of the cover cap 10 (FIG. 1) that may have been clamped onto the bottom 5 (FIG. 1). The auxiliary instrument 20 that may be electrically connected with the clock module 4—and possibly with its power supply—may comprise a device which accepts information from the clock module 4 and display or further process it; or a device which itself supplies information to the clock module 4 in order to possibly display such information by means of the wristwatch 1 acting as the display instrument; or a stationary peripheral device 20 provided with a contact arm for the placing or clamping of the wristwatch 1 while establishing contact by means of the contacts 9. Such a stationary peripheral device may comprise a frequency standard of a code pulse generator for the setting or synchronizing of the clock display or a charging device for the supply of a rechargeable battery of the wristwatch 1. The auxiliary instruments may be worn or carried by the wearer, for example pulse counters or step counters in order to be able to indicate the instantaneous pulse frequency or a distance covered in the course of a sporting activity by means of the wristwatch 1.

For the connection of external auxiliary instruments 20, the counter contacts 15 in the connector cap 16 are connected electrically with terminals 17 which are externally accessible and may comprise attachment plugs. Preferably, in the interest of the safety of the connection even during the movements of the wristwatch 1 by its wearer, the terminals 17 are in the form of connecting lines 18 leading outwardly from the connector cap 16 and terminating in plug connectors 19, to the extent that the connector cap 16 involved is not fixedly combined with a certain auxiliary instrument 20 and thus can be solidly wired together with such auxiliary instrument.

The connector cap 16 is conveniently styled with respect to the configuration of the housing 3 and in particular of the bottom 5 of the housing so that it may be frictionally joined with the housing 3 without the need for special skills but nevertheless with operational safety. For example, the cap 16 may be secured in a manner similar to the clamping of the above-mentioned cover 10 onto the periphery of the bottom 5 of the housing. For this purpose holding claws 21 may be provided on the edge of the cap which act in the manner of spring catches and encompass the lateral areas of the bottom 5 in a peripheral distribution or in a flange-like configuration. To achieve a positive alignment of the counter contacts 15 in the connector cap 16 with the fixed contact terminals 9, groovings may be provided in the edge of the bottom 5, which must cooperate with corresponding counter profiles in the holding claws 21 (not shown in the drawing), if the connector cap 16 is not rotating with respect to the housing 3, in order to create the desired alignment of components. The frictional connection of the connector cap 16 with the housing 3 may be reinforced by means of holding magnets 22, which may be placed individually or distributed in the form of a magnetic powder in the connector cap 16; they may be, for example, cast in place.

Contact between the counter contacts 15 of the connector cap 16 is also assured by the fact that the wristwatch 1, with the connector cap 16 arranged under the housing 3, is strapped by means of the bracelet 7 to the wearer's arm 8, whereby the surface of the arm generates pressure urging the connector cap 16 against the bottom 5 of the housing.

The releasable fastening of the connector cap 16 for the purpose of electrically connecting the auxiliary instruments 20 with the clock module 4 encased in the housing 3 may also be provided in a positive manner, for example in the form of a bayonet catch or a screw lock, as shown in simplified manner in the cutout representation of FIG. 3. In the case of such a connector cap 16 which is rotatable with respect to the bottom 5 around a center axis perpendicular to the principal plane of the bottom 5 of the housing, it is merely necessary that in the final connected position, electrical connection between the individual contact terminals 9 with the associated counter contacts 15 be established. To avoid dependence on an excessively accurate orientation of the connector cap 16 with respect to the bottom 5, the contact terminals 9 conveniently are distributed over the entirety of the surface of the bottom 5 and the counter contacts 15 are configured in the form of circular arcs at corresponding radial distances from the center axis 23 and concentrically to it.

It is even more advantageous to place all of the contacts 9 with respect to the center axis 23, throughout the principal plane of the bottom 5 in positions radially offset in relation to each other and to design the counter contacts 15 in the shape of concentric circular rings 24 suitably staggered within each other, so that in the final analysis the rotational position of the connector cap 16 with respect to the housing 3 becomes immaterial.

In keeping with an appropriate further embodiment, a pin 25 may be provided or formed in the connector cap 16, coincident with the center axis 23, which engages an orifice 26 in the bottom 5 and therein. By means of the pin deforming a diaphragm, without the orifice 26, a switching kicker 28 is actuated, in order to activate the electric contact of the contact surfaces 13 with the clock module 4 and/or the battery of the watch only when engagement of the counter contacts with the contact terminals 9 is assured.

Especially in the case when the counter contacts 15 are of a circular arc configuration, it is advantageous to design them in an elastically compressible manner so that as the result of a pressing and rotating movement during the fastening of the connector cap 16 to the bottom 5, the cleaning of the contact surfaces for a secure electrical connection is assured. The dimensions of the pin 25, together with that of the kicker 28 are such as to insure in the case of a screw lock (FIG. 3) between the connector cap 16' and the bottom 5 that the electrical connections inside the housing 3 are activated only after several rotations, i.e., following the corresponding cleaning of the contacts.

Within the scope of the invention, it may be particularly advantageous in keeping with a convenient further embodiment to design the connector cap 16 itself as the auxiliary instrument in the sense of the above-presented description, in place of the auxiliary instrument 20 or additionally to them (see the example of embodiment in FIG. 2), i.e., to install sensors 29 into the connector cap 16, which detect physical conditions to be evaluated by the clock module 4 and presented by means of the clock display. In the case of the example of a sensor 29 in accordance with FIG. 2, the latter serves perhaps to sense the body temperature and/or the pulse frequency of the wearer of the wristwatch 1. To alternatingly or simultaneously detect environmental conditions, such as the environmental temperature or the atmospheric pressure, suitable sensors are arranged alternatively or additionally in the free edge of the connector cap 16 (not shown in FIG. 2) and again connected electrically with the associated counter contacts 15 of the connector cap 16. The equipment of the connector cap 16 with the lead-in lines 18 for the connection of the auxiliary instruments 20 may then be omitted. In particular, it may be appropriate in practical applications of the invention to make available for standard wristwatches 1, connector caps 16 with integral sensors 29, i.e., connector caps 16 designed as peripheral devices 20, for different measuring and detection functions, so that only connector caps 16 equipped specifically for certain interests will be included with the watch, said connector caps being interchangeable according to need.

Although the invention has been described in connection with a preferred embodiment thereof, it will be appreciated by those skilled in the art that additions, modifications, deletions, and substitutions not specifically described may be made without departing from the spirit or scope of the invention as defined in the appended claims.

What is claimed is:

1. An electronic wristwatch comprising:

a housing, a clock module disposed within said housing, said module including electric contact surfaces, first electric contacts electrically connected with said contact surfaces and arranged on a bottom side of said housing, said first contacts enabling said module to be electrically connected to an auxiliary device, and interchangeable bottom cap individually attachable to said housing over said first contacts and sized to enable the watch to be worn on a wearer's arm when a bottom cap is attached, said bottom cap including second electric contacts arranged to engage different ones of said first contacts depending upon which bottom cap is attached to said watch, said bottom cap further including electrical connector means for attachment to an auxiliary device to electrically interconnect said module and the auxiliary device.

2. A wristwatch according to claim 1, wherein said bottom cap is connected frictionally to the housing.

3. A wristwatch according to claim 2, wherein said bottom cap is also magnetically connected to the housing.

4. A wristwatch according to claim 1, wherein said bottom cap is rotatable, said second contacts are of a circular arc configuration and are located concentrically relative to a center axis of said bottom cap and perpendicular to the plane of the bottom side of the housing.

5. A wristwatch according to claim 1, wherein the fastening of said bottom cap to the housing is responsive to rotation of the bottom cap relative to the housing about a center axis disposed perpendicular to the plane of the bottom side of the housing.

6. A wristwatch according to claim 1, wherein said first contacts are arranged at different distances from a center axis of the housing disposed perpendicular to the principal plane of the bottom side of the housing.

7. A wristwatch according to claim 1, wherein said bottom cap includes a contact kicker pin engaging the bottom side of the housing to activate said contact surfaces only upon attachment of said bottom cap.

8. A wristwatch according to claim 1, wherein said bottom cap includes a sensor which performs a measuring or detecting function.

9. A wristwatch according to claim 1, wherein said first contacts are held elastically against said contact surfaces.

10. A wristwatch according to claim 1, wherein said second contacts comprise surfaces.

11. A wristwatch according to claim 10, wherein said first contacts comprise pin-like members projecting through said bottom side of said housing.

12. A wristwatch according to claim 1 or 9, wherein said bottom cap comprises a wall, an inner side of which carries said second contacts and an outer side of which engages the arm of a wearer.

13. A wristwatch according to claim 1 further including a protective cover which is interchangeable with said bottom cap to protect said first contacts when no bottom cap is attached.

* * * * *